United States Patent [19]

Sasaki et al.

[11] Patent Number: 4,691,608

[45] Date of Patent: Sep. 8, 1987

[54] WAVEFORM NORMALIZER FOR ELECTRONIC MUSICAL INSTRUMENT

[75] Inventors: Hiroyuki Sasaki; Kohtaro Hanzawa, both of Tokyo, Japan

[73] Assignee: Casio Computer Co., Ltd., Tokyo, Japan

[21] Appl. No.: 910,207

[22] Filed: Sep. 22, 1986

[30] Foreign Application Priority Data

Sep. 30, 1985 [JP] Japan ..... 60-216744
Feb. 19, 1986 [JP] Japan ..... 61-32877

[51] Int. Cl.[4] ..... G10H 1/057; G10H 7/00

[52] U.S. Cl. ..... 84/1.01; 84/1.13; 84/1.26

[58] Field of Search ..... 84/1.26, 1.01, 10.3, 84/DIG. 9, 1.04, 1.19, 1.20, 1.21, 1.11, 1.12, 1.13, 1.16; 330/279, 129

[56] References Cited

FOREIGN PATENT DOCUMENTS 2023955 1/1980 United Kingdom .

*Primary Examiner*—Arthur T. Grimley
*Assistant Examiner*—David Warren
*Attorney, Agent, or Firm*—Frishauf, Holtz, Goodman & Woodward

[57] ABSTRACT

A CPU reads out sampled waveform data stored in a waveform memory and detects a peak value of the read-out data for each predetermined block using working registers, thereby obtaining an interpolated envelope curve. The CPU then divides the sampled waveform data by the interpolated envelope curve to obtain a normalized sound waveform without any envelope in an original sound signal.

19 Claims, 12 Drawing Figures

WAVEFORM NORMALIZER FOR ELECTRONIC MUSICAL INSTRUMENT

BACKGROUND OF THE INVENTION

This invention relates to a waveform normalizer for an electronic musical instrument, which normalizes a waveform obtained by storing an externally supplied sound signal to generate a waveform suited as a tone waveform signal.

Heretofore, there have been developed various electronic musical instruments which have a sampling function of receiving and digitally recording an externally supplied sound signal and reading out the recorded sound signal as a waveform signal to be provided as a note signal.

Electronic musical instruments having such a sampling function are also disclosed in patent applications U.S. Ser. Nos. 760,290 filed on July 29, 1985, 760,291 filed on July 29, 1985 and now U.S. Pat. No. 4,667,556, U.S. application based on Japanese patent application Nos. 60-200259, 60-201301 and U.S. application based on Japanese patent application Nos. 60-202698, 60-205516, 60-207147 and 60-207150, these U.S. applications being assigned to the assignee of this invention.

In these prior art electronic musical instruments, the sound signal is directly sampled and stored.

As is well known in the art, a sound has an instantaneously changing level, and in the field of electronic musical instruments it is thought that the waveform of an original sound is superimposed on a waveform called envelope to generate a musical tone. The envelope has an amplitude changing with the lapse of sounding time. In the prior art electronic musical instrument with a sampling function, a waveform signal including the envelope is usually stored.

Therefore, when a sampled tone including envelope is reproduced at a desired pitch for musical performance, the rate of reading of the waveform of the sampled tone varies with the pitch, so that the envelope time also varies with the pitch, that is, it is impossible to obtain a uniform envelope time.

In some case, a digitally recorded waveform signal is read out as a note signal at a predetermined rate to be converted into an analog signal before providing an envelope thereto through a voltage controlled amplifier (VCA) or the like. In this case, the resultant signal is a combination of the initial envelope and subsequently added envelope in superimposition thereon, so that it is difficult to obtain sufficient envelope control.

Further, when a continued tone is to be generated through a loop function by repeatedly reading out a particular portion of a waveform signal like that noted above, a level difference appears outstandingly at the juncture between adjacent waveforms in case when the waveform signal includes an envelope of attenuating type. Such level difference leads to a click or like noise. Thus, such a loop function can be obtained only for a short portion of the stored waveform.

SUMMARY OF THE INVENTION

An object of the invention is to provide a waveform normalizer for an electronic musical instrument, with which an optimum waveform as a tone signal of an electronic musical instrument with a sampling function can be obtained through normalization of an input waveform signal.

According to the invention, there is provided a waveform normalizer for an electronic musical instrument, in which an input waveform signal is converted into a digital signal, stored in waveform memory means and converted into a sound signal having a designated frequency, which comprises envelope extracting means for extracting an envelope signal from the input waveform signal, normalization processing means for normalizing the input waveform signal according to an envelope signal extracted from the envelope extracting means to obtain a normalized waveform signal, and control means for causing the normalized waveform signal obtained from the normalization processing means to be supplied to and stored in the waveform memory means.

DETAILED DESCRIPTION OF THE PREFERRED EMBODIMENTS

Figure 1:
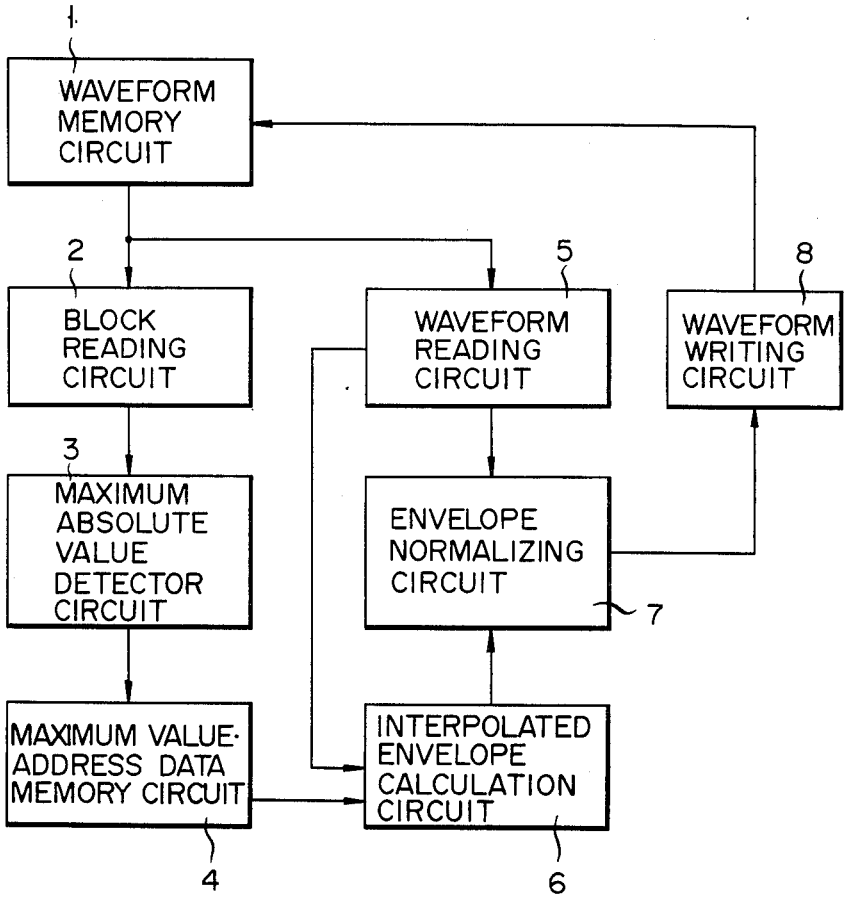
FIG. 1 is a functional block diagram showing a first embodiment of the invention.

Now, the invention will be described in conjunction with embodiments illustrated in the drawings.

First Embodiment

FIGS. 1 to 5 illustrate a first embodiment of the invention. FIG. 1 is a block diagram illustrating a function of the first embodiment, particularly CPU 3 thereof, shown in FIG. 2. Reference numeral 1 designates waveform memory circuit for storing waveform signal. Waveform signals can be externally set in advance.

Block reading circuit 2 reads out waveform signal stored in waveform memory circuit 1 block by block constituted by a predetermined address width. The width of the block may be fixed independently of or variable according to the frequency of an input signal.

A waveform signal read out by block reading circuit 2 is supplied to maximum absolute value detector circuit 3. Maximum absolute value detector circuit 3 detects an address of the maximum absolute value in the block as well as the maximum absolute value and supplies these data to maximum value/address data memory circuit 4. Thus, the maximum absolute values and corresponding addresses for all the blocks are alternately stored in maximum value/address data memory circuit 4.

The output of maximum value/address data memory circuit 4 is supplied together with sampled value of waveform read out by waveform reading circuit 5 to interpolated envelope calculation circuit 6. Interpolated envelope calculation circuit 6 calculates an interpolated envelope value which is supplied to envelope normalizing circuit 7.

Envelope normalizing circuit 7 performs a predetermined calculation with the sampled value supplied from waveform reading circuit 5 and interpolated envelope value supplied form interpolated envelope calculation circuit 6 to eliminate an initial envelope of the waveform signal, thereby obtaining a normalized sampled value.

This normalized sampled value is sent to waveform writing circuit 8 and thence to waveform memory circuit 1 to re-write the data stored therein.

In the above way, a waveform signal having an envelope is deprived of the envelope according to an interpolated envelope value calculated by interpolated envelope calculation circuit 6 to obtain a waveform with an envelope having a substantially constant value. In other words, through this sequence of processes a normalized waveform signal can be obtained.

Figure 2:
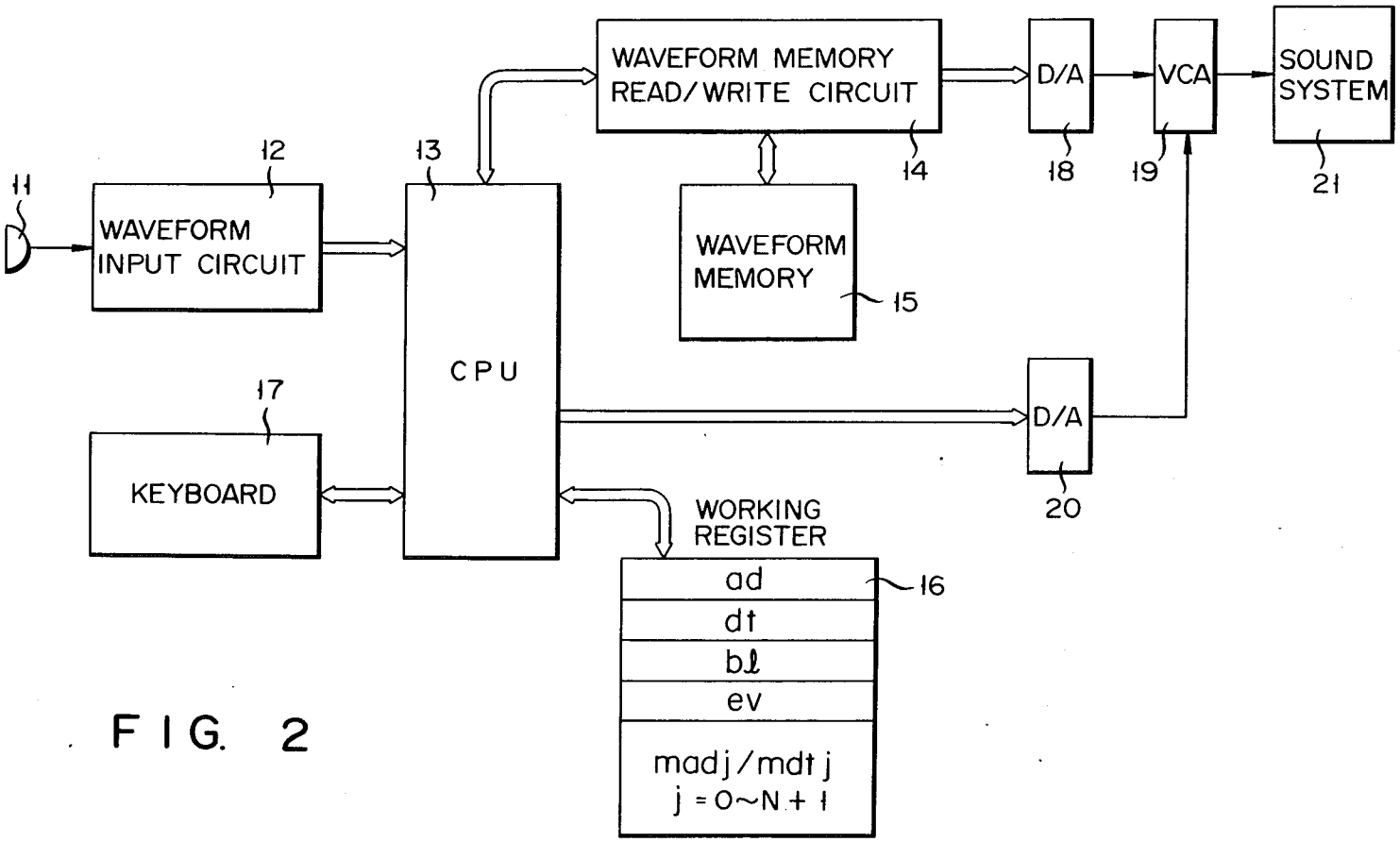
FIG. 2 is a block diagram showing a specific circuit construction of the first embodiment shown in FIG. 1.

FIG. 2 shows a constitution for realizing the function shown in FIG. 1, the function being implemented using CPU 13, e.g., microprocessor. Referring to FIG. 2, a sound signal coupled through a microphone 11 is sampled by waveform input circuit 12 at a suitable sampling frequency for conversion into a digital signal which is supplied to CPU 13.

The input waveform signal is fed from CPU 13 to waveform memory read/write circuit 14 to be eventually stored in waveform memory 15. Thus, a waveform signal having the envelope of the input sound is digitally stored in waveform memory 15.

CPU 13 performs a processing of removing the envelope of the waveform signal stored in waveform memory 15 through normalization. Working registers 16 that are used in this processing include an address register (ad register), a data register (dt register), a block register (bl register), an envelope register (ev register), a $mad_j/mdt_j$ register, etc. In these registers are stored data and address data to be described later.

CPU 13 is connected to keyboard 17, and it performs various processes in accordance with key operation on keyboard 17. Further, CPU 13 controls waveform memory read/write circuit 14 such that a normalized waveform signal is read out from waveform memory 15 at a predetermined rate corresponding to each note in accordance with the operation of performance keys on keyboard 17.

A digital signal read out from waveform memory 15 is supplied to D/A converter 18 through waveform memory read/write circuit 14 to be converted into an analog signal, which is supplied to voltage controlled amplifier (VCA) 19.

CPU 13 calculates through software processing an envelope signal, which is converted by D/A converter 20 into an analog signal. The analog signal is supplied to VCA 19 to determine the applification factor thereof. VCA 19 thus provides a waveform signal having an envelope designated by CPU 13. The output of VCA 19 is converted by sound system 21 into a sound output.

Figure 3A:
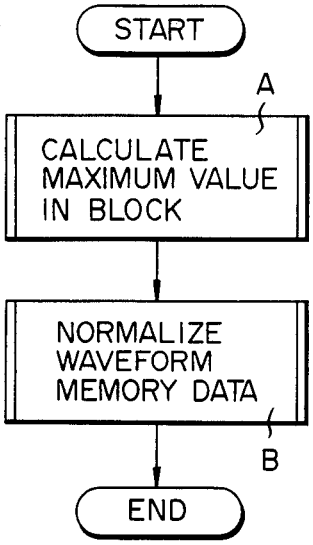
FIGS. 3A to 3C show, in combination, a flow chart illustrating the operation of the first embodiment.

The operation of this embodiment will now be described with reference to the flow chart shown in FIGS. 3A to 3C. A sequence of operations concerned consists of routine A in FIG. 3A for determining an address corresponding to a maximum absolute value among sampled values in a block and the maximum absolute value and a routine B for normalizing data stored in waveform memory 15 from the result of routine A.

Figure 3B:
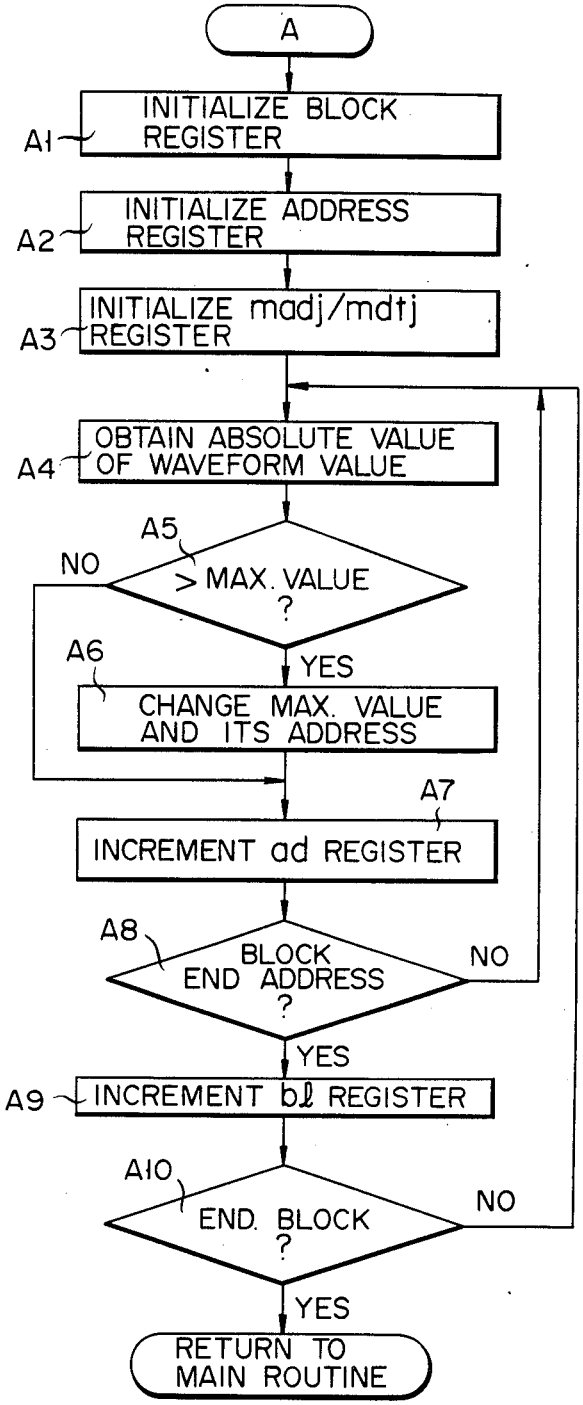

In routine A of FIG. 3B, the block register (bl register) among working registers 16 is initialized in step A1. In other words, data "1" is set to designate the first block. A block means each of areas of waveform memory 15 when the memory is divided at a predetermined block size or address width BS.

In subsequent step A2, the address register (ad register) is initialized. That is, the data in the ad register is made data designating the first address of waveform memory 15. In subsequent step A3, data in the $mad_j/mdt_j$ register is initialized, which stores an address corresponding to the maximum one of the absolute sampled values and that maximum value.

More specifically, when waveform memory 15 is divided such that it has blocks 1 to N, the data in $mad_j/mdt_j$ register is set to zero for $j=1$ to N. As for the data in $mad_j/mdt_j$ for imaginary block $j=0$ immediately preceding first block $j=1$, the address is set to a value obtained as a result of subtraction of the block width (i.e., block size BS) from the first address of waveform memory 15, and the maximum value is set to zero. Likewise, as for the data in $mad_{N+1}/mdt_{N+1}$ register for imaginary block $J=N+1$ immediately succeeding last block $j=N$, the address is set to a value obtained as a result of addition of block size BS to the last address of waveform memory 15, and the maximum value is set to zero.

After the above series of initialization processings, the maximum value in each block is detected in a processing of step A4 and following steps. First, in step A4 sampled value data in waveform memory 15 designated by data of the ad register is read out, and the absolute value of the read-out value is obtained.

In subsequent step A5 a check is done as to whether the absolute value obtained is greater than the absolute value $mad_{b1}$ in the prevailing block that has already been recorded. If the decision is YES, the routine goes to step A6 of changing the data in $mad_j/mdt_j$ register.

The routine then goes to step A7. If a decision of NO is yielded in step A5, step A7 is executed. In step A7, the data in the ad register is incremented.

In subsequent step A8, a check is done as to whether the data in the ad register represents the last address of the pertinent block, that is, whether the data in the ad register coincides with a value of $b1 \times BS$. If the decision is NO, the routine returns to step A4 to repeat the processing steps A4 through A8. In this way, the maximum value in the block and the corresponding address are obtained.

Figure 4:
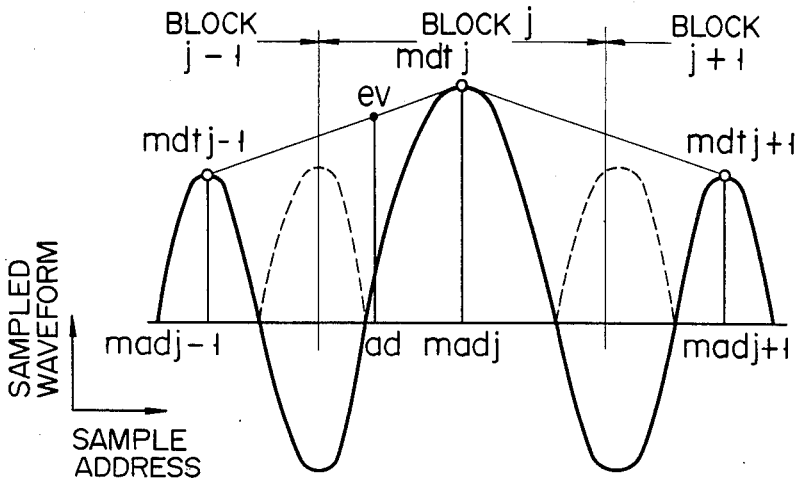
FIG. 4 is a view showing an extracted envelope.

FIG. 4 shows the relation between the sample address in each block and the corresponding maximum value. The values as illustrated are stored in $mad_j/mdt_j$ registers ($j=bl$). In the Figure, waveform shown by dashed line is obtained by taking absolute values of negative sampled values.

When the processing for the pertinent block is ended, a decision of YES is yielded in step A8, and the routine goes to step A9, in which the data in the bl register is incremented. In subsequent step A10, a check is done as to whether the pertinent block is the last or end block $J=N$. If the decision is YES, the routine returns to the main flow. If the decision is NO, the routine returns to step A4 to start processing with respect to the next block.

In the above way, the address corresponding to the maximum absolute value of sampled values in each block ($j=1$ to N) and that maximum value are stored in $mad_j/mdt_j$ register.

Figure 3C:
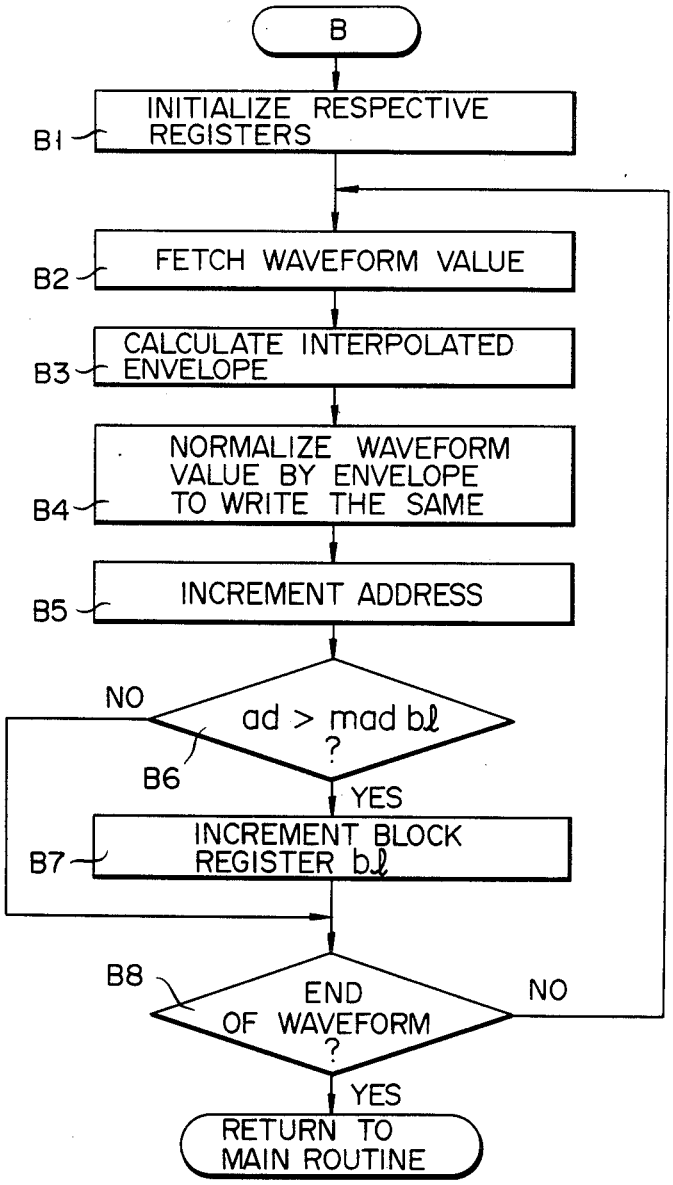

Now, a processing of normalization of waveform memory 15 in routine B is executed as shown in FIG. 3C.

First in step B1, an address designating the first address in waveform memory 15 is set in the ad register among working registers 16. At the same time, a value "1" designating the first address is set in the bl register.

In subsequent step B2, the sampled value of waveform in the address designated by the ad register is read out from waveform memory 15 and is set in the dt register among working registers 16.

In subsequent step B3, an interpolation envelope value is calculated and supplied to the ev register. More specifically, an interpolated envelope value eV is obtained from the maximum value $mdt_{j-1}$ in the preceding block, maximum value $mdt_j$ in the pertinent block and the corresponding address ad.

The value ev is given as $$eV = mdt_{bl-1} + (mad_{bl-1} - ad) \times \{(mdt_{bl} - mdt_{bl-1})/(mad_{bl} - mad_{bl-1})\}$$

With j=bl, correspondence to the value shown in FIG. 4 can be obtained.

In subsequent step B4, waveform normalization is effected using the interpolated envelope value ev at the address point obtained in the above way. More specifically, a calculation is done on the basis of an equation $$Dt = MV \times dt/ev.$$

Where MV represents a level to be normalized, e.g., 700 in base 16 system in this embodiment. The interpolated envelope value ev is an approximation to the initial envelope of the waveform so that it gives rise to an error. Therefore, a normalized value in excess of the value of MV is liable to be obtained depending on the input waveform. Therefore, where the maximum value of waveform is expressed as 2's complement of 12 bits, for instance, the value should be smaller than 7FF (which is a base 16 system number).

The normalized sampled value Dt is set in the pertinent address of waveform memory 15. Then, in step B5 the data in the ad register is incremented.

In subsequent step B6, the data in the ad register and the data in the $mad_{bl}$ register are compared. When the former data exceeds the latter data, the routine goes to step B7, in which the data in the bl register is incremented.

The routine then goes to step B8. If a decision of NO is yielded in step B6, step B8 is also executed. In step B8, a check is done as to whether the normalization processing has been proceeded up to the last sampled value of the waveform. If it is not yet, the routine returns to step B2.

Steps B2 to B8 are repeatedly executed to complete the normalization processing for all the sample points.

Figure 5:
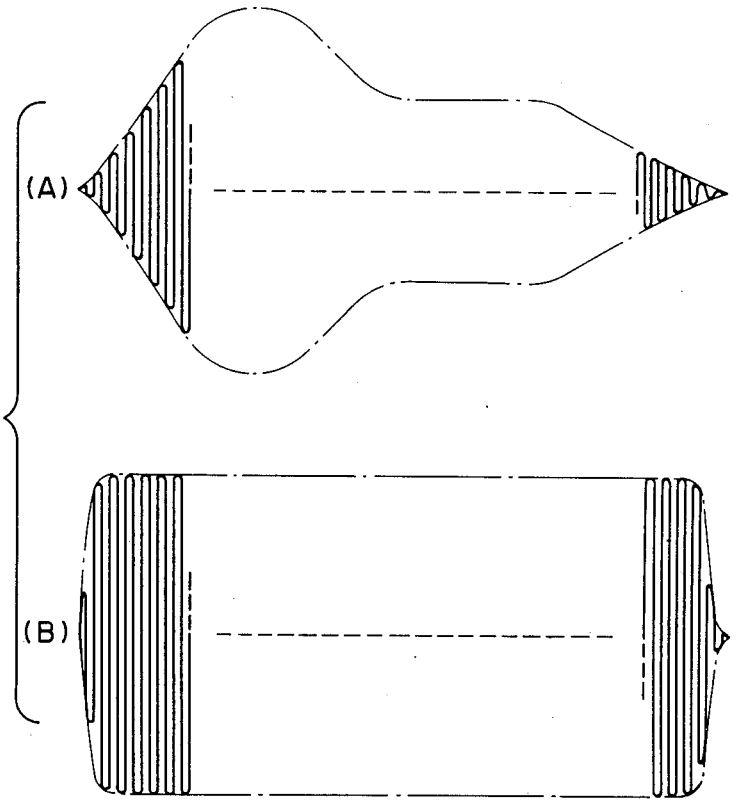
FIG. 5 shows waveforms before and after normalization.

A normalized waveform which is obtained in the above way is shown in (B) in FIG. 5. An input waveform signal having an envelope as shown in (A) in FIG. 5 (the envelope being shown by phantom lines) is deprived of the envelope, i.e., converted to a waveform signal having a substantially fixed envelope (corresponding to MV, shown by phantom lines) through the execution of routines A and B.

Thus, in this embodiment effective envelope control can be obtained by reading out sampled values of waveform stored in waveform memory 15 and adding an envelope to the read-out data in VCA 19 since the initial envelope of the input waveform signal has been removed.

Further, even when a portion of the stored waveform data in waveform memory 15 is read out repeatedly, no undesired click or like noise is generated since the envelope is substantially fixed.

While in the above embodiment the data in waveform memory 15 is changed to the normalized waveform signal, it is also possible to write the normalized waveform signal in a separate waveform memory.

Further while in the above embodiment the interpolation envelope value is calculated using the equation noted above and is used as denominator to divide sampled value of waveform to obtain a normalized sampled value, it is also possible to adopt other argorithms so long as the initial envelope of the input waveform signal is removed.

In other words, it is possible to adopt various arrangements as means for extracting the envelope waveform, e.g., one, in which maximum values of individual blocks of a waveform are obtained and used as a group, one, in which maximum minus minimum value of individual blocks of a waveform is obtained and used as a group, one, in which square sums of maximum values of individual blocks of a waveform are obtained and used as a group, and one, in which sums of absolute values of amplitude of individual blocks of a waveform are obtained and used as a group.

As has been shown, in the above embodiment an externally supplied sound signal is once digitally written in a waveform memory, the stored digital signal is normalized by removing the initial envelope, and the normalized signal is written in the waveform memory. This method is very effective for obtaining a tone waveform signal for an electronic musical instrument.

Second Embodiment

Now, a second embodiment of the invention will be described with reference to FIGS. 6 to 10. In this embodiment, unlike the previous first embodiment, normalization of waveform is done on real time every time an waveform is input.

Figure 6:
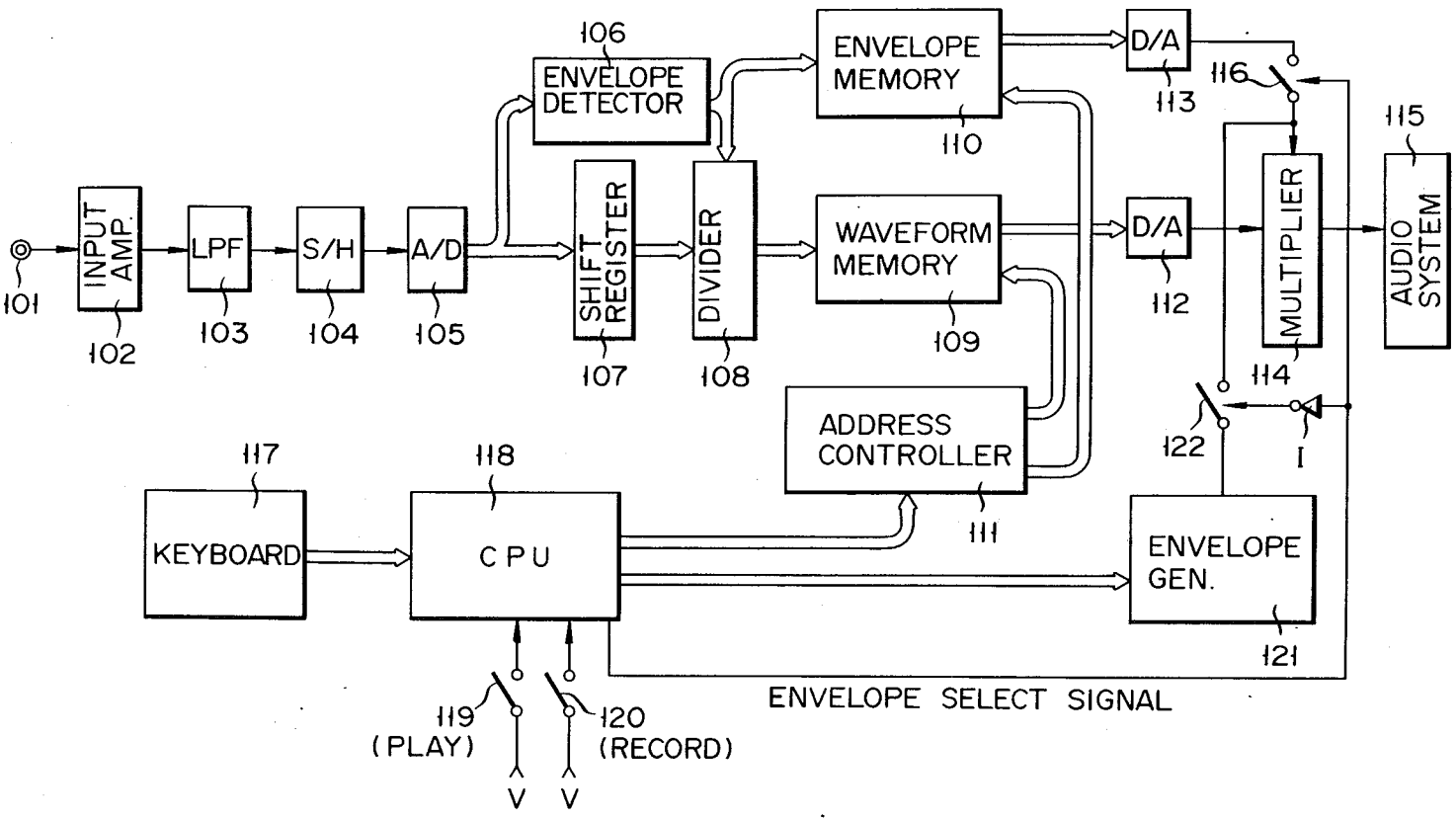
FIG. 6 is a schematic representation of a second embodiment of the invention.

FIG. 6 shows the entire circuit construction of electronic musical instrument with sampling function. An external tone signal from a microphone (not shown) is supplied through external tone input terminal 101 to input amplifier 102. The amplified signal is fed to low-pass filter 103 to cut a high frequency component and then sampled in sample/hold circuit 104 at a predetermined frequency. The output of sample/hold circuit 104 is converted in A/D converter 105 into a digital signal, which is supplied to envelope detector 106 and also supplied through shift register 107 to divider 108. Envelope detector 106 detects the envelope of the sampled external tone signal and supplies envelope data thus obtained to divider 108.

Divider 108 divides the sampled external tone waveform level data from A/D converter 105 by envelope level data to extract a waveform where the envelope level is assumed to be constant. In other words, a uniform waveform without envelope, i.e., a normalized waveform, is extracted from the waveform of external tone including an envelope.

The extracted uniform waveform data is written in waveform memory 109. Envelope data from envelope detector 106 is also written in envelope memory 110. Waveform data in waveform memory 109 is read out under control of read address of address controller 111 to be converted in D/A converter 112 into an analog signal which is supplied to multiplier 114. Meanwhile, envelope data from envelope memory 110 is read out under control of read address of address controller 111 to be converted in D/A converter 113 into an analog signal, which is supplied through switch 116 to multiplier 114. Multiplier 114 multiplies the waveform signal by the envelope signal to produce a tone signal representing the externally supplied tone, which is supplied to audio system 115 to be sounded. Address controller 111 effects write address control even in the writing of data in waveform memory 109.

CPU 118 detects the operation of each key on keyboard 117, and incrementation of the read address of address controller 111 is effected at a rate corresponding pitch of the operated key. The switching between the writing and reading of address controller 111 is effected by CPU 118 when play key 119 or record key 118 is turned on.

Envelope data of various predetermined patterns different from the envelope provided from envelope memory 110 can be selectively provided from envelope generator 121 under control of CPU 118 to be supplied through switch 122 to multiplier 114 to provide various envelopes to the waveform data from waveform memory 109. An envelope selection signal is supplied from CPU 118 through inverter I to switch 122, while it is directly supplied to switch 116, and either envelope data from envelope generator 121 or that from envelope memory 110 is selectively supplied to multiplier 114.

Figure 7:
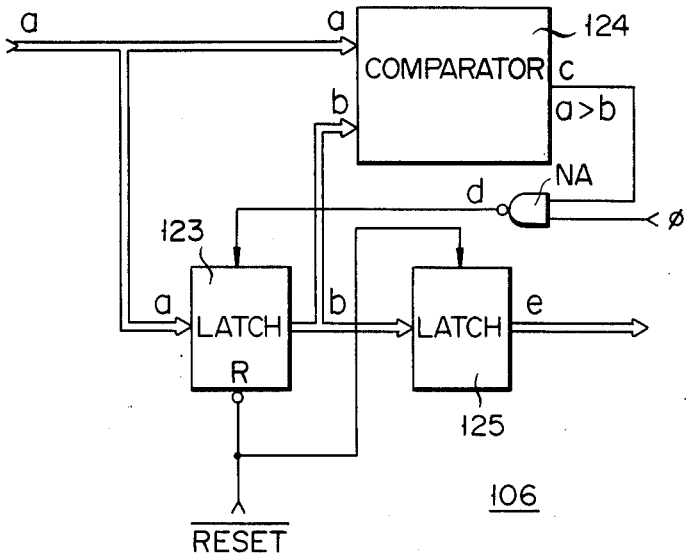
FIG. 7 is a view showing an envelope detector in a second embodiment of the invention.

FIG. 7 shows a specific circuit construction of envelope detector 106. Waveform level data a of the sampled external tone from A/D converter 105 is lathed in latch 123 to be supplied to comparator 124, while it is also directly supplied to comparator 124. Comparator 124 compares latched data b from latch 123 and waveform level data a which is progressively changed. When data a becomes higher than data b, comparator 124 provides comparison result signal d which is supplied through NAND gate NA as latch signal d to latch 123. Latch data b in latch 123 is thus progressively changed to greater values. To NAND gate NA is also supplied clock signal $\phi$ at the same frequency as the sampling frequency to take synchronization of the latching of data in latch 123 with respect to the sampling period. To latch 123 is further supplied a reset signal which has 8 times the cycle period of clock signal $\phi$, and the maximum value of waveform level data a in latch 123 is extracted as latch data a in latch 123. This maximum value serves as envelope level data. The latch data b which serves as envelope data is latched in latch 125 at a timing, at which the reset signal is supplied as latch signal, to be supplied as envelope level data e in divider 108.

Now, the operation of the embodiment will be described.

Figure 8:
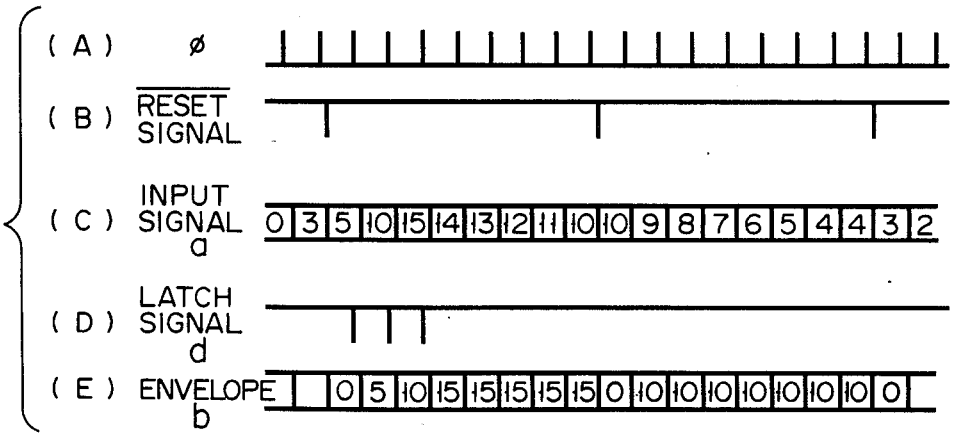
FIG. 8 is a time chart showing the operation.
Figure 9:
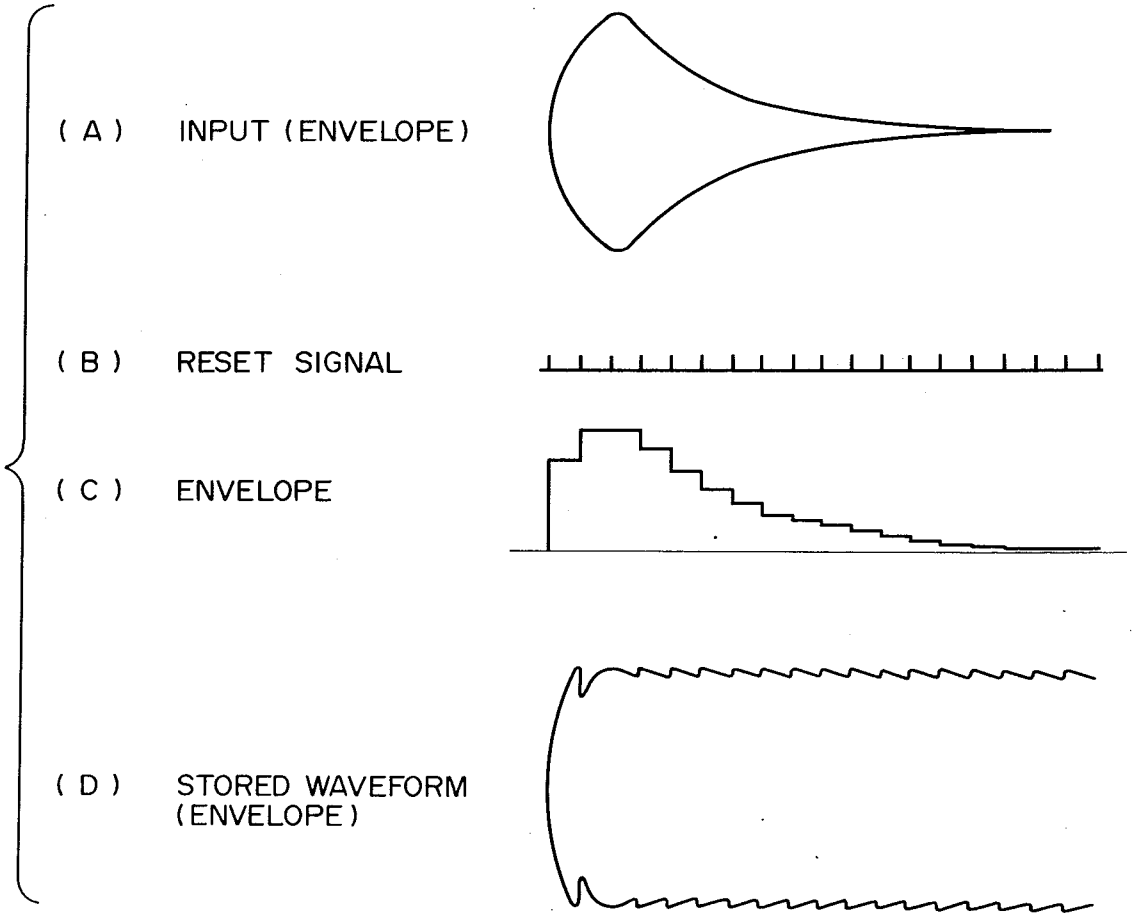
FIG. 9 is a view illustrating a normalizing operation performed with a digital divider.

It is assumed that a waveform having an envelope as shown in (A) in FIG. 9 is supplied from external tone input terminal 101, and its sampling level is obtained as values as shown in (C) in FIG. 8. Then, after the reseting of latch 123 latched data b is progressively changed to "5", "10", "15", as waveform level data a of the input waveform is changed to "5", "10", "15", "14", "13", . . . . Subsequently, latched data b remains "15" while waveform data a is reduced to "15"–, "14", "13", . . . . That is, the maximum value of "15" is held. This value is provided ad envelope level data e. Likewise, in the subsequent period after the next reseting the maximum value of "10" is provided as envelope level data e.

Shown in (C) in FIG. 9 is envelope level data which is obtained in the above way. It corresponds very well to the input waveform shown in (A) in FIG. 9. Divider 108 divides waveform level data of the input waveform shown in (A) in FIG. 9 by envelope level data shown in (C) in FIG. 9. The waveform that is obtained as a result of the division is uniform and does not include any envelope. This waveform is written in waveform memory 109. Shown in (D) in FIG. 9 is the envelope of stored waveform. It will be seen that a waveform signal having a substantially constant level is extracted and stored.

Figure 10:
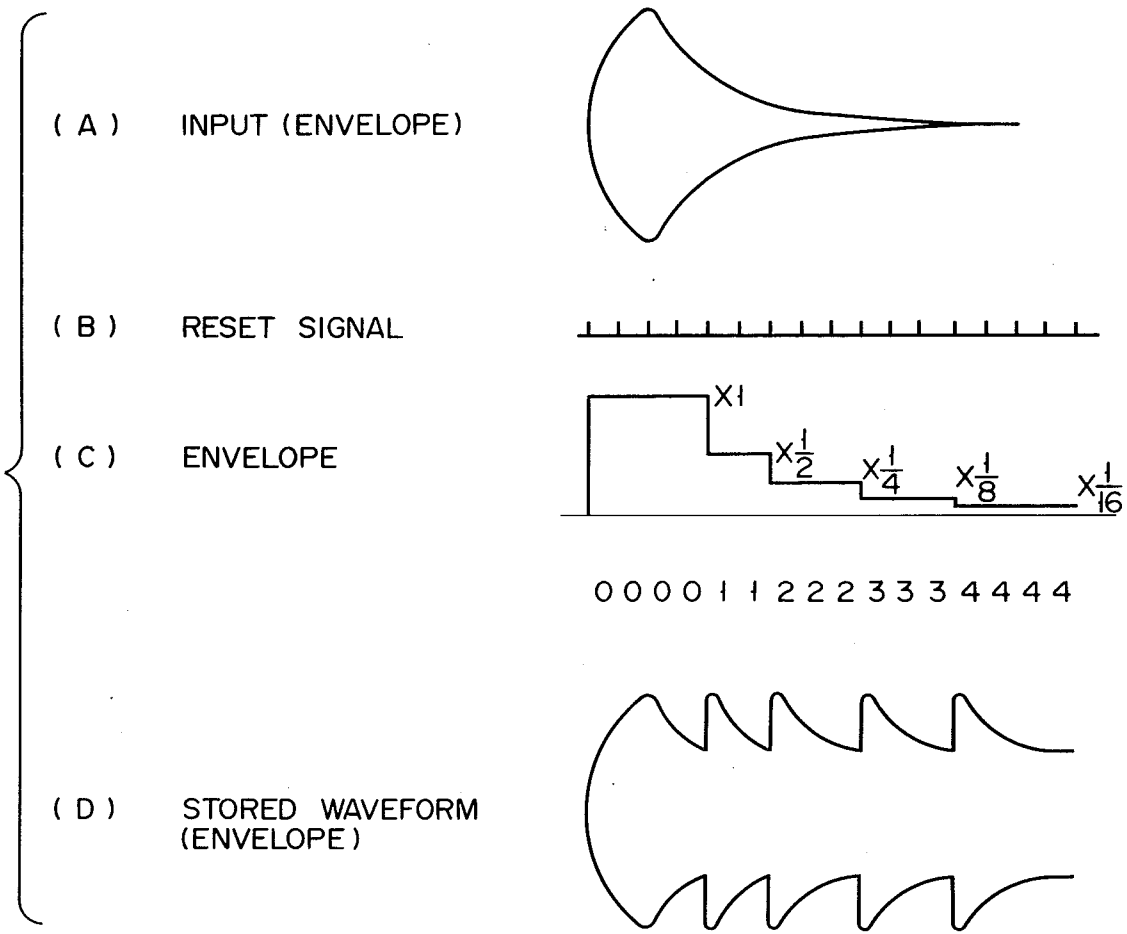
FIG. 10 is a view illustrating a normalizing operation performed with a shifter.

In the above way, the waveform of an externally supplied tone can be stored in a uniform form separated from envelope.

Where an input data bit shifter is used for divider 108, the waveform level data is shifted by one bit upwards, i.e., it is doubled, when the envelope level data is reduced to one half of the maximum peak value, as shown in (C) in FIG. 10. The waveform data is shifted by 2 bits upwards, i.e., it is increased to 4 times, when the envelope level data becomes one fourth of the peak. In this way, the waveform level data is increased to 8 times, 16 times and so forth when the envelope level data becomes $\frac{1}{8}$, 1/16 and so forth of the peak. Even in this case, the same effects can be obtained as in the case where a divider is used to divide the waveform level data by envelope level data.

In the above way, the waveform of an externally supplied tone can be stored in a uniform form separated from envelope, i.e., in a normalized form, although slight variations are involved, as shown in (D) in FIG. 10.

Where the shifter as noted above is used for divider 108, it is possible to simplify the construction of divider 108.

While in the above embodiment a digital divider or a shifter has been used as divider 108, it is possible to use an analog divider. In general, any circuit may be used to this end so long as it is possible to calculate the ratio of the waveform level to the envelope level.

In the above embodiment, the maximum value in each block of waveform is used again to divide each amplitude value for normalization of the input waveform. However, it is also possible to obtain normalization of waveform by dividing each amplitude value by the maximum absolute value of amplitude in each block or dividing each amplitude value by the maximum minus minimum value in each block or dividing each amplitude value by the sum of squares of maximum values in the individual blocks or the sum of absolute values of amplitude.

Further, the length of each block, i.e., frequency of generation of the reset signal, may be fixed or may be made variable depending on the input waveform frequency.

Envelope memory 110 in the above embodiment, which can store the envelope of the original waveform to be used for the tone generation, is not an essential element. For example, it is possible to give the normalized waveform signal a desired envelope from envelope generator 121 for envelope control.

In the above embodiment, the extraction of envelope and normalization of input signal are done on real time. This is convenient for operation in case of an electronic musical instrument with a sampling function.

As has been described in the foregoing, according to the invention the ratio of the waveform level of an externally supplied tone to the envelope level thereof is progressively calculated, for instance by dividing the waveform level by the envelope level, to make uniform, i.e., normalize the waveform level of the externally supplied tone independent of the envelope level. Thus, in sampling and storing the the external tone, the waveform thereof can be stored independently of its envelope and in a uniform form, that is, the stored external tone waveform does not contain any envelope. By reading out this stored external tone waveform at a rate based on the pitch, the envelope period is never varied depending on the pitch, but a uniform envelope period can be obtained even if the rate of reading of waveform is varied. In addition, since the stored external tone waveform does not contain any envelope, it is possible to give an envelope which is selected from among an envelope extracted from the external tone and any given envelope to the stored waveform. This means that a variety of tomes can be obtained from an externally supplied tone.

What is claimed is:

1. A waveform normalizer for an electronic musical instrument, in which an input waveform signal is converted into a digital signal, stored in waveform memory means and converted into a sound signal having a designated frequency, comprising:

envelope extracting means for extracting an envelope signal from said input waveform signal;

normalization processing means for normalizing said input waveform signal according to an envelope signal extracted from said envelope extracting means to obtain a normalized waveform signal; and control means for causing said normalized waveform signal obtained from said normalization processing means to be supplied to and stored in said waveform memory means.

2. The waveform normalizer for an electronic musical instrument according to claim 1, wherein:

said envelope extracting means includes detecting means for dividing said input waveform signal into a plurality of blocks and progressively detecting an address corresponding to a maximum absolute value of said input waveform signal in each said block and said maximum value; and said normalization processing means includes calculating means for removing the envelope of said input waveform signal through normalization of said input waveform signal from said maximum value and said corresponding address for each said block detected by said detecting means.

3. A waveform normalizer for an electronic musical instrument according to claim 2, wherein:

said detecting means includes interpolated envelope value calculating means for calculating an interpolated envelope value from said maximum value and said corresponding address for each said block; and said calculating means includes sample value calculating means for calculating each sample value of a normalized waveform signal from said interpolated envelope value calculated by said interpolated envelope value calculating means and each sample value of said input waveform signal.

4. The waveform normalizer for an electronic musical instrument according to claim 3, wherein:

said interpolated envelope value calculating means calculates an interpolated envelope value eV on the basis of an equation $$eV = mdt_{bl-1} + (mad_{bl-1} - ad) \times \{(mdt_{bl} - mdt_{bl-1})/(mad_{bl} - mad_{bl-1})\}$$

where bl is a block number, mdt is a maximum value in a pertinent block, mad is an address corresponding to said maximum value, and ad is an address corresponding to a sample value of said input waveform signal; and said sample value calculating means calculates a sample value Dt of said normalized waveform signal on the basis of an equation $$Dt = MV \times dt/eV$$

where dt is a sample value of said input waveform signal before said normalization, and MV is a level value to be normalized.

5. The waveform normalizer for an electronic musical instrument according to claim 1, wherein said normalization processing means progressively calculates the ratio of the level of an envelope signal extracted by said envelope extracting means to the waveform level of said input waveform signal to obtain a uniform level independent of the level of said envelope signal as a waveform level of said input waveform signal, thereby obtaining said normalized waveform signal.

6. The waveform normalizer for an electronic musical instrument according to claim 5, wherein said normalization processing means includes means for progressively calculating on real time the ratio of the waveform level of said input waveform signal to the level of an envelope signal from said normalization processing means.

7. A waveform processing apparatus comprising:

waveform memory means for digitally storing an input waveform signal;

first means for dividing a waveform signal stored in said waveform memory means into a plurality of blocks and calculating an envelope signal for each said block by reading out said stored waveform signal for each said block;

envelope memory means for storing said envelope signal calculated by said first means; and second means for removing the envelope of said input waveform signal by normalizing said stored waveform signal in said waveform memory means according to said envelope signal stored in said envelope memory means.

8. The waveform signal processing apparatus according to claim 7, wherein said first means calculates said envelope signal for each said block by detecting the maximum absolute value of said stored waveform signal in said waveform memory means for each said block.

9. The waveform signal processing apparatus according to claim 7, wherein said first means calculates said envelope signal for each block of said stored waveform signal in said waveform memory means by detecting the maximum value of said waveform signal for each said block.

10. A waveform signal processing apparatus comprising:

waveform memory means for digitally storing an input waveform signal;

detecting means for dividing a waveform signal stored in said waveform memory means into a plurality of blocks and progressively detecting an address corresponding to a maximum absolute value of the waveform signal in each said block and said maximum value by reading out said stored waveform signal for each said block;

maximum value/address storing means for storing said maximum value and said corresponding address for each said block detected by said detecting means; and calculating means for removing the envelope of said input waveform signal by normalizing said stored waveform signal in said waveform memory means from said maximum value and said corresponding address for each said block stored in said maximum value/address memory means.

11. The waveform signal processing apparatus according to claim 10, wherein said calculating means includes:

interpolated envelope value calculating means for calculating an interpolated envelope value from said maximum value and said corresponding address for each said block stored in said maximum value/address memory means; and envelope normalizing means for calculating each sample value of the normalized waveform signal from said interpolated envelope value calculated from said interpolated envelope value calculating means and each sample value of said stored waveform signal in said waveform memory means.

12. The waveform signal processing apparatus according to claim 11, wherein:

said interpolated envelope value calculating means calculates an interpolated envelope value eV on the basis of an equation $$eV = mdt_{bl-1} + (mad_{bl-1} - ad) \times \{(mdt_{bl} - mdt_{bl-1})/(mad_{bl} - mad_{bl-1})\}$$

where bl is a block number, mdt is a maximum value in a pertinent block, mad is an address corresponding to said maximum value, and ad is an address corresponding to a sample value of said input waveform signal; and said envelope normalization processing means calculates a sample value Dt of said normalized waveform signal on the basis of an equation $$Dt = MV \times dt/eV$$

where dt is a sample value of said input waveform signal before said normalization, and MV is a level value to be normalized.

13. An electronic musical instrument with a sampling function, comprising:

sampling means for sampling an input waveform signal;

waveform memory means for storing sampled waveform signal sampled by said sampling means as a digital signal;

waveform memory read/write circuit means for controlling the reading and writing of data with respect to said waveform memory means;

a central processing unit for receiving data stored in said waveform memory means and causing said received data to be subjected to a predetermined processing and then stored again in said waveform memory means;

D/A conversion means for receiving said stored waveform signal progressively read out from said waveform memory means at a rate designated by said waveform memory read/write circuit means; and a sound system for generating a sound signal according to the output of said D/A conversion means;

said central processing unit executing:

a first step for dividing said waveform signal read out from said waveform memory means into a plurality of blocks and calculating an envelope signal for each said block; and a second step for normalizing said waveform signal stored in said waveform memory according to said envelope signal calculated in said first step and storing said normalized waveform signal again in said waveform memory means.

14. An electronic musical instrument with a sampling function, comprising:

waveform detecting means for detecting the waveform of an externally supplied tone by detecting the level of said waveform;

envelope detecting means for detecting the envelope level of said externally supplied tone;

calculating means for providing a waveform having a uniform level independent of the envelope level from said envelope detecting means as a waveform level of said externally supplied tone through progressive real time calculation of the ratio of the waveform level from said waveform detecting means to said envelope level from said envelope detecting means; and waveform memory means for storing said waveform calculated by said calculating means.

15. An electronic musical instrument with a sampling function according to claim 14, wherein said envelope detecting means detects an envelope level from a maximum value of the waveform level of the externally supplied tone for each predetermined interval of time.

16. The electronic musical instrument with a sampling function according to claim 14, wherein said envelope detecting means detects the envelope level from the maximum absolute value of the waveform level of the externally supplied tone for every predetermined interval of time.

17. The electronic musical instrument with a sampling function according to claim 14, wherein said calculating means includes dividing means for dividing the waveform level from said waveform detecting means by an envelope level detected by said envelope detecting means to thereby obtain said waveform.

18. The electronic musical instrument according to claim 17, wherein said dividing means consists of a shift circuit.

19. The electronic musical instrument with a sampling function according to claim 14, wherein said envelope detecting means includes:

a latch circuit;

a comparator circuit for comparing a waveform level signal having been stored in said latch circuit and a waveform level signal supplied at present;

means for changing the data in said latch circuit to said waveform level signal supplied at present when it is detected by said comparator circuit that said waveform level signal supplied at present is greater than said waveform level signal having been stored in said latch circuit; and means for extracting data in said latch circuit as said envelope level for a predetermined period of time for each said predetermined period of time and initializing said latch circuit.

* * * * *